US008584746B2

(12) United States Patent
Marya et al.

(10) Patent No.: US 8,584,746 B2
(45) Date of Patent: Nov. 19, 2013

(54) OILFIELD ISOLATION ELEMENT AND METHOD

(75) Inventors: Manuel P. Marya, Sugar Land, TX (US); John Fleming, Damon, TX (US); Larry W. Phillips, Angleton, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 711 days.

(21) Appl. No.: 12/697,738

(22) Filed: Feb. 1, 2010

(65) Prior Publication Data

US 2011/0186306 A1 Aug. 4, 2011

(51) Int. Cl.
*E21B 33/12* (2006.01)

(52) U.S. Cl.
USPC ..... 166/192; 166/300; 166/376; 166/317

(58) Field of Classification Search
USPC ..... 166/300, 376, 192, 317
See application file for complete search history.

(56) References Cited

U.S. PATENT DOCUMENTS

| | | | | |
|---|---|---|---|---|
| 5,479,986 | A * | 1/1996 | Gano et al. | 166/292 |
| 5,607,017 | A * | 3/1997 | Owens et al. | 166/288 |
| 7,093,664 | B2 | 8/2006 | Todd et al. | |
| 7,168,494 | B2 | 1/2007 | Starr et al. | |
| 7,353,879 | B2 | 4/2008 | Todd et al. | |
| 7,377,321 | B2 | 5/2008 | Rytlewski | |
| 8,113,290 | B2 * | 2/2012 | Sharma et al. | 166/376 |
| 2007/0044958 | A1 | 3/2007 | Rytlewski et al. | |
| 2007/0107908 | A1 | 5/2007 | Vaidya et al. | |
| 2007/0181224 | A1 * | 8/2007 | Marya et al. | 148/400 |
| 2008/0149345 | A1 | 6/2008 | Marya et al. | |
| 2009/0226340 | A1 * | 9/2009 | Marya | 419/32 |
| 2010/0209288 | A1 | 8/2010 | Marya et al. | |
| 2011/0132619 | A1 * | 6/2011 | Agrawal et al. | 166/376 |

FOREIGN PATENT DOCUMENTS

| | | | |
|---|---|---|---|
| CA | 2529913 | C | 1/2009 |

* cited by examiner

*Primary Examiner* — William P Neuder
*Assistant Examiner* — Elizabeth Gitlin
(74) *Attorney, Agent, or Firm* — David J. Groesbeck; Brandon S. Clark

(57) ABSTRACT

An isolation element includes a body having at least one sealing surface, an internal cavity within the body, and a chemical agent disposed within the internal cavity. The chemical agent is configured to substantially increase a rate of degradation of the body.

18 Claims, 5 Drawing Sheets

OILFIELD ISOLATION ELEMENT AND METHOD

BACKGROUND OF THE INVENTION

1. Field of the Invention

The invention relates generally to the field of oilfield isolation elements. Specifically, the invention relates to degradable isolation elements.

2. Background Art

It is common to use isolation elements, such as plugs or darts, to temporarily block fluid flow in tubular equipment. The tubular equipment may include oilfield tubular equipment, and tubular equipment used in geothermal wells, injection wells, and carbon dioxide sequestration wells. Isolation elements are used so that fluid pressure and flow may be applied to a specific portion of a well, without damaging or effecting downstream equipment. FIG. 1 shows a schematic of a well where such a device may be useful.

FIG. 1 shows a well 1 with a tubular 2 placed in the well 1. A casing 3 lines an upper portion of the well 1. Below the casing shoe 4, completion equipment is installed in the open hole. The equipment is designed to isolate two zones in the formation 5, an upper zone 11 and a lower zone 12. The upper zone 11 is bounded by an upper packer 6 and a lower packer 8, and the lower zone is bounded by an upper packer 10. It is noted that the lower zone 12 may also be bounded by a lower packer, although one is not shown in FIG. 1. It is also noted that wells may include more or less than two zones, as is known in the art.

In one example, it may be desirable to perform an operation on the upper zone 11, such as a gravel pack or a hydraulic fracture, without effecting the lower zone 12. The zones 11, 12 are isolated by the packers 6, 8, 10, which prevent fluid communication in the annulus outside the tubular string 2. Before the operation may begin, however, fluid communication between the two zones 11, 12 within the tubular string 2 must be prevented.

To accomplish this, a dart or plug, known in the art, may be dropped, lowered on a tool, or otherwise released into the tubular string 2 so that is seats in the seat 15. Once the dart is seated in the seat 15, fluid flow and pressure may be applied above the seat 15, and the dart will prevent fluid communication below the seat 15. A fracture or gravel pack operation may be performed on the upper zone 11, without effecting the lower zone 12 or the equipment below the seat 15.

Once the operation is performed, the dart (not shown) must be removed so that fluid communication within the tubular string 2 is reestablished.

SUMMARY OF THE INVENTION

In one aspect, the invention relates to an isolation element that includes a body having at least one sealing surface, an internal cavity within the body, and a chemical agent disposed within the internal cavity. The chemical agent may be configured to substantially increase a rate of degradation of the body.

In another aspect, the invention relates to a method of actuating a downhole tool in a well that includes positioning a tool in a wellbore using a tubing string, introducing a isolation element into the tubing string, as the isolation element descends in the tubing string, rupturing a bladder within the isolation element using hydrostatic pressure present in the tubing string, wherein the rupturing releases a material for substantially increasing a rate of degradation of a body of the isolation valve, and after the isolation lands in a flow restriction orifice, actuating the downhole tool by increasing fluid pressure within the tubing string.

In another aspect, the invention relates to a method of actuating a downhole tool in a well that includes positioning a tool in a wellbore using a tubing string, introducing an isolation element into the tubing string, degrading a plug in the isolation element, exposing a chemical agent for substantially increasing a rate of degradation of a body of the isolation element, and after the isolation is positioned in a flow restriction orifice, actuating the downhole tool by increasing fluid pressure within the tubing string.

In another aspect, the invention relates to an isolation element that includes a body having at least one sealing surface, the body comprising at least two sections, at least one internal cavity within one of the sections of the body, a chemical agent disposed within the internal cavity, and a connector disposed within the body, holding the at least two of the sections together. The chemical agent may be configured to substantially increase a rate of degradation of the body.

Other aspects and advantages of the invention will be apparent from the following description and the appended claims.

DETAILED DESCRIPTION

In order to block fluid communication in a wellbore, it is known in the art to use an isolation member, such as a dart, plug, or ball. Once the operation requiring the isolation is over, the isolation member is typically removed, so that flow may be reestablished though the orifice where the isolation member was seated.

It is also known in the art to use an isolation member that is made from a degradable material, so that is may degrade, for example by dissolving or disintegration, to the point where is can no longer provide isolation. U.S. Patent Application Publication 2007/0181224, assigned to the assignee of the present invention, discloses degradable compositions that may be used for temporary plugs (see, e.g., paragraph 43). U.S. Patent Application Publication 2008/0149345, assigned to the assignee of the present invention, discloses downhole devices that include degradable materials. U.S. Patent Application Publication 2008/0105438, assigned to the assignee of the present invention, discloses using degradable materials to form a whipstock, for the purpose of drilling a lateral well. The whipstock may degrade following the lateral drilling operation, thereby avoiding the need to remove it. Each of these publications is incorporated by reference in its entirety.

In the above-mentioned applications, the device constructed from a degradable material is degraded or consumed from the outside. That is, the degradation begins on the external surface of the device, and it continues at a rate determined by the materials, well fluids, temperature, and pressure until the device is fully degraded. In the examples described below, a device constructed of a degradable material may be degraded from within. The degradation from within may be in addition to or in lieu of external degradation.

Figure 1:
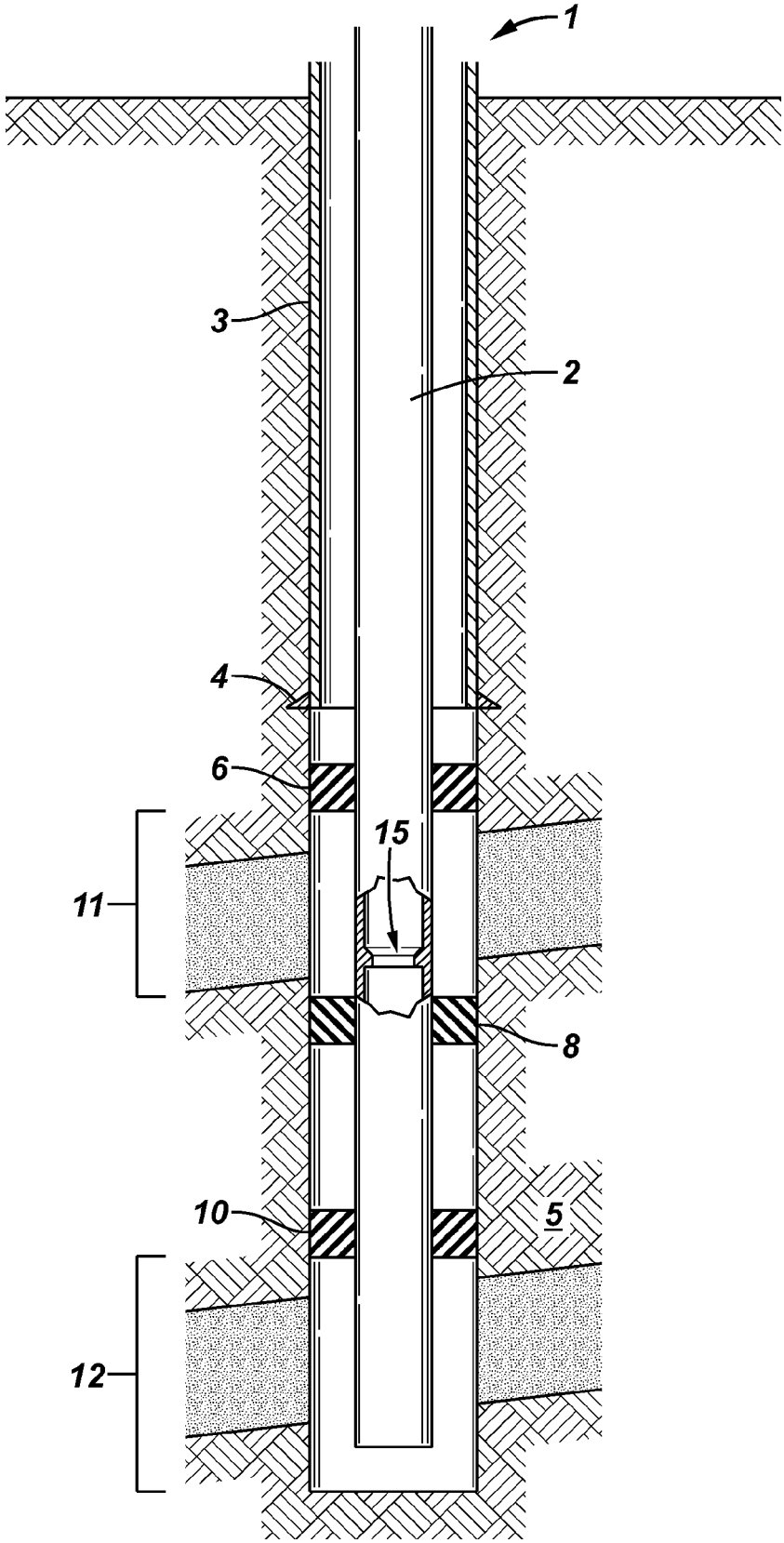
FIG. 1 shows a schematic of an oilfield well with completion equipment installed in the well.
Figure 2A:
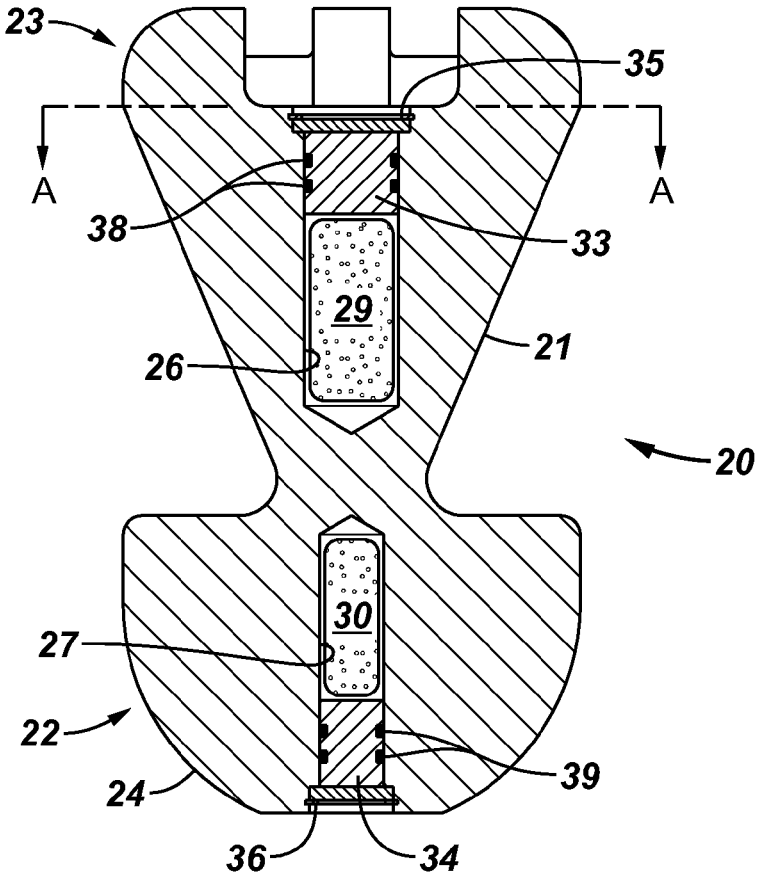
FIG. 2A shows a cross-section view of one example of an isolation element.

FIG. 2A shows a schematic of an example isolation element, in this example a dart 20, that may be used to block fluid communication in an oilfield tubular, such as tubular 2 in FIG. 1. It is noted that an isolation element or device may have other forms, such as a ball or a plug.

The dart 20 includes a head section 22 and a tail section 23. The head section 22 is, in general, the lower end of the dart 22, and it includes a sealing surface 24 that may seat in an orifice, such as an orifice specifically designed to seat a dart, such as seat 15 in FIG. 1. The tail section 23 may be formed, as is typical, to orient and guide the dart 20 as it descends through the fluid in a well.

The example dart shown in FIG. 2A includes two internal cavities 26, 27. The internal cavities 26, 27 may include a chemical agent for substantially increasing the degradation of the dart 20. For example, a dart may be constructed of a material that will degrade in the well fluid. The chemical agent may cause the rate of degradation to increase. In another example, a dart may be constructed of a material that does not degrade in well fluids. The chemical agent may cause the degradation of the dart, thereby increasing the rate of degradation from zero.

In yet another example, the chemical agent itself may not cause degradation, but it may change the environment around the dart such that, in combination with other elements in the wellbore, the rate of degradation is substantially increased. For example, the chemical agent may form part of an exothermic reaction, and the heat given off by the reaction may speed an ongoing external degradation. In another example, the chemical agent may be released to mix or react with wellbore fluids to create a chemical or compound that degrades the dart. Examples of chemical agents and their operation are provided below.

Returning to FIG. 2A, the cavities 26, 27 may have a passage to the outside of the body 21 of the dart 20. The passage may include a plug. For example, cavity 26 includes a plug 33 that is exposed to the exterior of the dart 20 on one end and to the interior of the cavity 26 on another end. The plug 33 is shown with two seals 38, which may be used to prevent fluid communication between the exterior of the dart 20 and the cavity 26. The lower cavity 27 also includes a plug 34 with seals 39 to isolate the cavity 27 from the exterior of the dart 20.

Figure 2B:
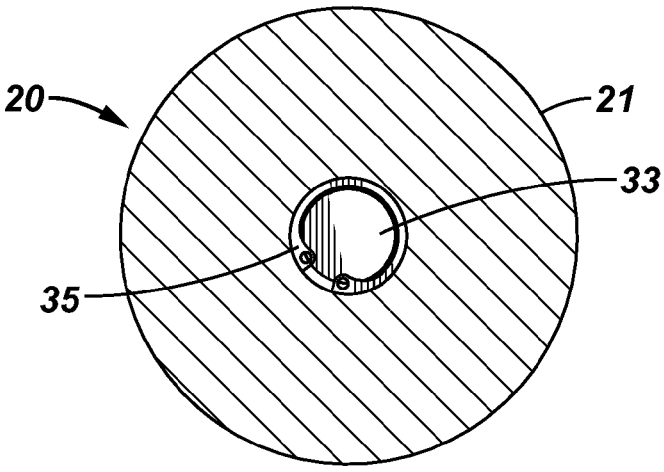
FIG. 2B shows a cross-section along line A-A in FIG. 2A.

A plug may be held in place by a retaining ring. For example, the upper plug 33 is shown in FIG. 2A being retained by retaining ring 35. FIG. 2B shows a cross section, along line A-A in FIG. 2A, of the dart 20. The plug 33 is held in place by a retaining ring 35. FIG. 2A also shows a retaining ring 36 used to hole the lower plug 34 in place, as well.

A cavity within a dart or other isolation element may include a chemical agent to substantially increase a degradation rate of the dart. Activation of the chemical agent may occur in one of many ways. In one example, a chemical agent may need no activation. It may be present within a dart or isolation element, and it may degrade the device from within. In such an example, the device may be implemented and used before the chemical agent is able to degrade the device beyond a useful limit.

In another example, a chemical agent may be disposed within a soluble bladder within a cavity. A plug, separating the cavity from the outside of the isolation element, may allow well fluids to enter the cavity to dissolve the bladder, thereby releasing the chemical agent. A plug may allow well fluids to enter the cavity by several means. In one example, a plug may dissolve or otherwise degrade in the well fluids over time. Once the degradation proceeds far enough, well fluids may penetrate into the cavity. In such an example, the plug may be configured to move within the cavity to balance the external hydrostatic pressure. In another example, a plug may include a rupture disc or other device that may respond to the external hydrostatic pressure. Upon rupturing, the well fluids may enter the cavity. In another example, a plug may be configured to move within the cavity in response to external pressure, and it may include a structure that will puncture a bladder within the cavity once the external hydrostatic pressure exceeds a selected value.

In the particular example shown in FIG. 2A, the dart 20 includes a bladder 29 disposed within the upper cavity 26. The plug 33 is configured to equalize the pressure between the cavity 26 and the outside of the dart 20. The plug 33 is constructed of a material that degrades in well fluid. For example, where the dart 20 is to be used in a water-based mud, the plug 33 may be degradable in water. For oil based muds, the plug 33 may be degradable in oil. The specific materials and composition of the plug 33 may be selected based on the well fluids and the desired degradation rate. Once the plug 33 is sufficiently degraded, well fluids may enter the cavity 26, and the bladder 29 will be exposed to the well fluids. The bladder 26 may also be selected to be degradable in well fluids so that once exposure to well fluids occurs, the bladder 26 will degrade and release the chemical agent within the bladder.

Likewise, the example dart 20 shown in FIG. 2A includes a plug 34 in the lower cavity 27. The plug 34 is configured to compensate the external and internal pressures, and it degrades in well fluids, so that once the degradation proceeds past a certain point, the bladder 30 in the cavity 27 will be exposed to well fluids. The bladder 30 may degrade in the well fluids and release a chemical agent.

A person having skill in the art may envision alternate examples. An isolation element may include only one cavity, or it may include three or more. The two cavities 26, 27 shown in FIG. 2A are intended only as an example.

Figure 3:
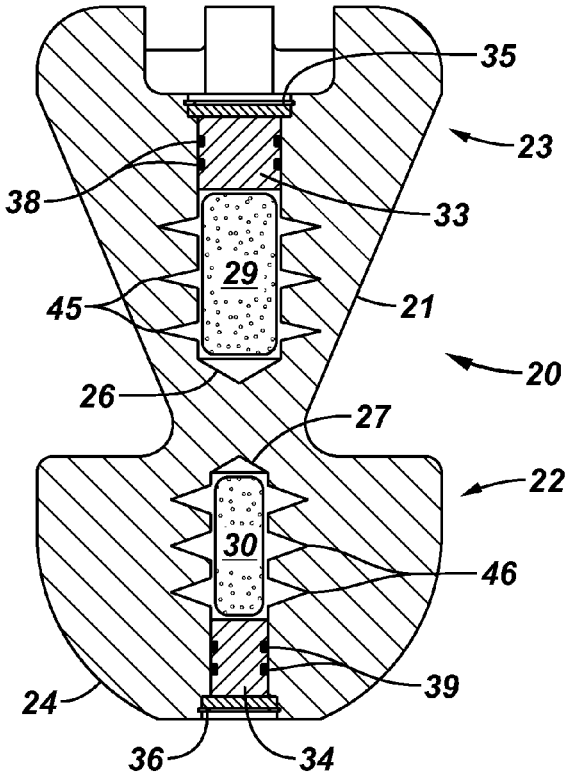
FIG. 3 shows a cross-section view of another example of an isolation element.

FIG. 3 shows another example of a dart 20 with an upper and lower cavity 26, 27, each with a plug 33, 34 and a bladder 29, 30. One or more chemical agents may be disposed within the bladders 29, 30. The upper cavity 26 includes a degradation enhancement feature 45 than enables the chemical agent, when released, to act on a larger surface area inside the cavity 26. The term "degradation enhancement feature" is used to mean any feature, other than a smooth surface, that will enhance the degradation that is caused by the release of a chemical agent. In the example shown in FIG. 3, the degradation enhancement feature 45 comprises projections into the body 21 of the dart 20. In this example, the degradation enhancement feature 45 provides a larger surface area on which the chemical agent may act, and it provides a path for the chemical agent to penetrate into the body 21 of the dart 20, thereby enhancing or increasing the rate of degradation. The lower cavity 27 of the dart 20 shown in FIG. 3 also includes a degradation enhancement feature 46. Although FIG. 3 shows two cavities, each with similar degradation enhancement features, that is not required. The design of each cavity in an isolation element or device and the selection of a degradation enhancement device may be done differently for each cavity. That is, one cavity may include a certain degradation enhancement feature, while another cavity, if included, may include a different degradation enhancement feature, or none at all.

Those having skill in the art may devise many types of degradation enhancement features. Such features may include drilled holed, grooves, scratches, etching or scoring, cracks, and other features that may enhance degradation caused by a chemical agent.

Figure 4:
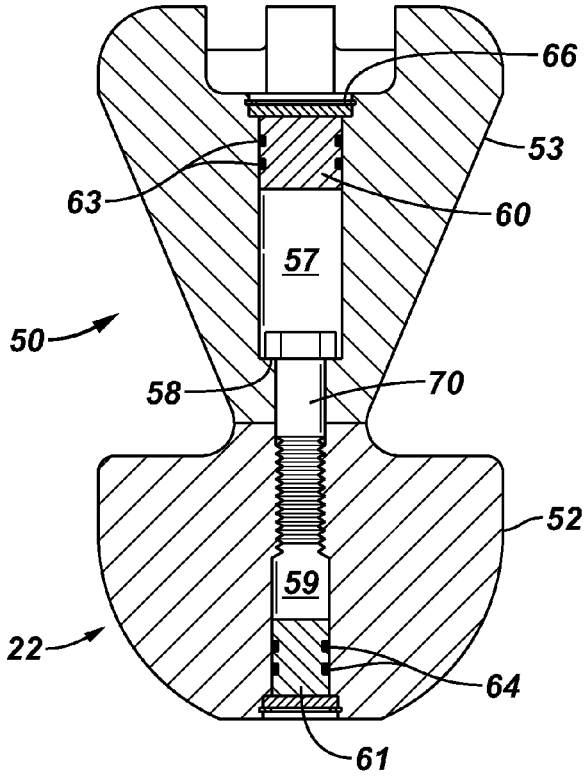
FIG. 4 shows a cross-section view of another example of an isolation element.

FIG. 4 shows another example of an isolation element, and in particular a dart 50 having a head section 52 and a tail section 53. The head section 52 and the tail section 53 are not integral, but are instead connected by a fastener. In the example in FIG. 4, the fastener is a bolt 55. The head section includes a central passageway 59, and the tail section includes a central passageway 57, as well. The bolt 70 is positioned within the central passageways 57, 59 to connect the head section 52 and the tail section 53. In the particular example in FIG. 4, the central passageway 57 in the tail section 53 includes a shoulder 58, where the head of the bolt 70 may rest. The central passageway 59 in the head section 52 may include threads so that the bolt 70 may be screwed or threaded into the head section 52, thereby connecting the head section 52 and the tail section 53.

As shown in FIG. 4, each of the passageways 57, 59 may include a plug 60, 61 at an open end. The plug 60 in the passageway 57 in the tail section 53 includes seals 63 so that the plug may seal the inside of the central passageway 57 in the tail section 53 from the environment outside the dart 50. Likewise, the plug 61 in the passageway 59 in the head section 52 may also include seals 64 to seal the passageway 59 from the environment outside the dart 50. In this example, the passageways 57, 59 may not include a chemical agent. Instead, the bolt 70 may be made of a material that is soluble in the well fluids. One or both of the plugs 60, 61 may degrade in the well fluids so that well fluids may enter one or both passageways 57, 59. When well fluid entered the passageways 57, 59, the bolt 70 would be exposed to the well fluid and it would dissolve. Once dissolution of the bolt 70 progressed far enough, the bolt 70 would no longer be able to hold the tail section 53 and the head section 52 together. The sections 52, 53 may separate, thereby increasing the surface area of the dart 50 that is exposed to well fluids and enabling the degradation of the dart 50 to proceed at an enhanced rate.

Figure 5:
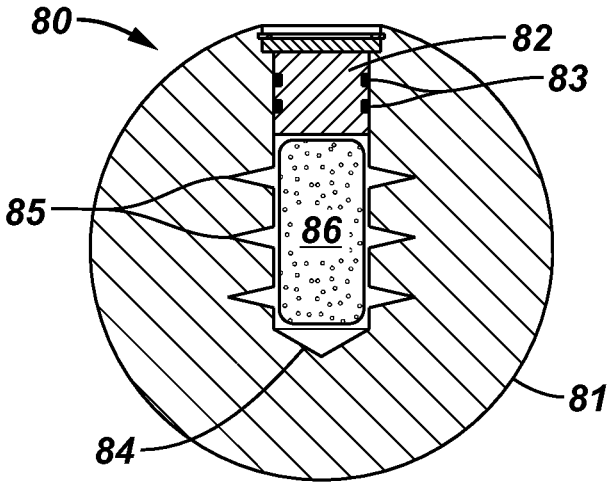
FIG. 5 shows a cross-section view of another example of an isolation element.

FIG. 5 shows an example of a ball 80 that may be used as an isolation element. The ball 80 includes a cavity 84 that is enclosed from the exterior of the ball 80 by a plug 82 having seals 83. The cavity 84 may include degradation enhancement features 85 and a bladder 86 that may be used to contain a chemical agent.

Figure 6:
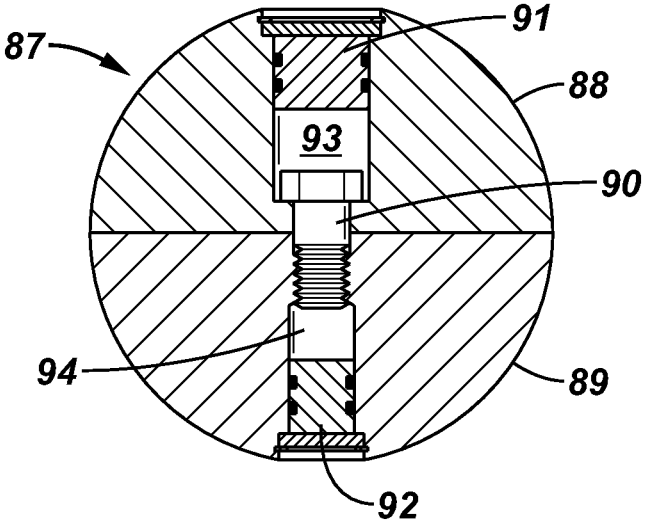
FIG. 6 shows a cross-section view of another example of an isolation element.

FIG. 6 shows another example of a ball 87 that may be used as an isolation element. The ball 87 includes two halves 88, 89 that are held together by a bolt 90 positioned within central passageways 93, 94 within each half 88, 89. The ends of the passageways 93, 94 may be plugged with a plug 91, 92 to prevent well fluid from entering the passageways 93, 94. One or more of the plugs 91, 92 may degrade in well fluid to the point that well fluid may enter one or more of the passageways 93, 94. Upon exposure to well fluid, the bolt 90 may dissolve so that is no longer connects the two halves 88, 89.

In examples where an isolation element includes a chemical agent, the chemical agent may be an agent that when released, will substantially increase the rate of degradation of the device. For example a chemical agent may be an acid that when released, will speed the degradation of the device. Such acids include hydrochloric acids, fluoric acids, and nitric acids. In another example, a chemical agent may be a chemical or compound that will react with well fluids or water to release heat. Such exothermic reactions may substantially increase the rate of degradation of the device from the well fluids by adding heat. Such exothermic compounds include both bases and acids. For example, exothermic bases may include metal hydroxides—such as sodium hydroxide, potassium hydroxide, lithium hydroxide, and cesium hydroxide—as well as any hydration chemicals (e.g. salts) leading to substantial exothermicity (e.g., metallic nitrates like calcium, magnesium, aluminum, or zinc nitrates, sulfates incorporating similar metals like magnesium sulfates, etc). Acids that may react exothermically with well fluids include hydrogen bromide, hydrogen chloride, hydrogen iodide, aluminum chloride, sulfuric acids, and percholoric acids. It is noted that some acids may serve both as a consuming agent and an exothermic reactant.

Table 3 shows hoe temperature and acids may be used in combination to substantially increase a degradation rate.

TABLE 3

| Temp. (C. °) | Approx. Degradation Rate (mm/hr) | Acidity Level (pH or HCl % in water) |
|---|---|---|
| 25 | 0.5 | 6 |
| 55 | 1.0 | 6 |
| 70 | 2.0 | 6 |
| 85 | 4.0 | 6 |
| 70 | 4.0 | 1% HCl |
| 70 | 12.0 | 10% HCl |

Figure 7:
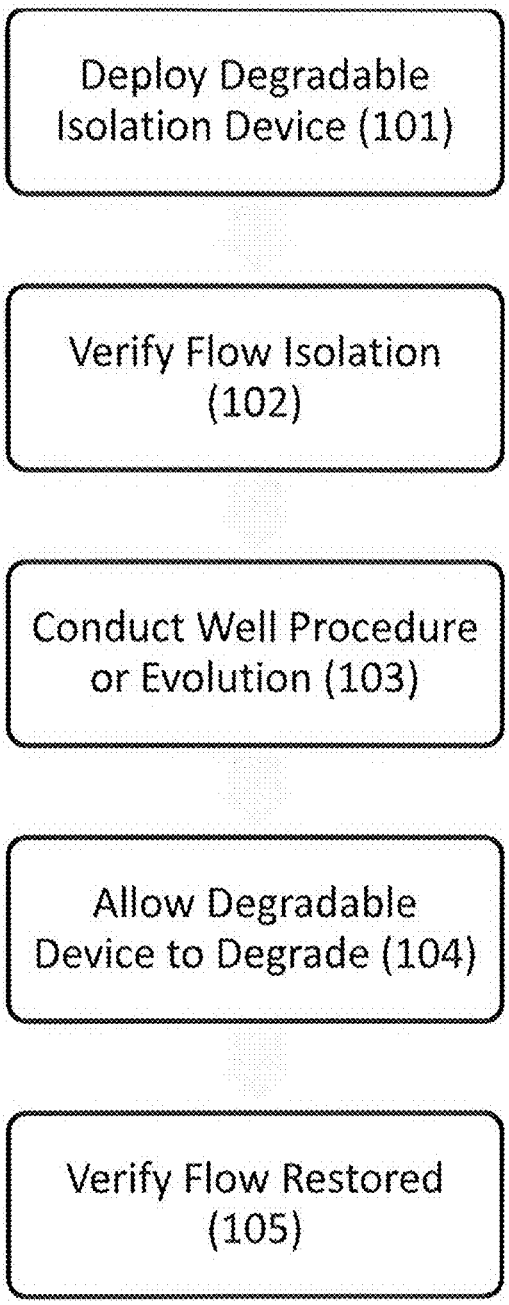
FIG. 7 shows an example method for performing a well operation.

As shown in Table 3, the degradation rate as a pH of 6 increases from 0.5 mm/hr at a temperature of 25° C. to a rate of 4.0 mm/hr at 70° C. Thus, a chemical or compound that reacts exothermically with well fluids, such as water, can substantially increase the degradation rate through the addition of heat to the already present degradation of the isolation element. Table 3 further shows that at a constant temperature of 70° C., the degradation rate will increase from 4.0 mm/hr to 12.0 mm/hr when the concentration of hydrochloric acid is increased from 1% to 10%, in water. Thus, the release of acid as a chemical agent in a isolation element In practice and shown in FIG. 7, an isolation element may be released or deployed into a tubular member in a well at a time when flow isolation in the tubular member is desired, at 101. The device may be allowed to descend in the well until it seats in a seat designed to receive the device. In another example, the device may be deployed on a service tool. Once seated, pressure from above the device may cause it to seal against the seat. Flow isolation may be verified by pumping fluid into the isolated tubular member. An increase in pressure, caused by the flow isolation element seated in the seat, will verify isolation, at 102.

Next, a well procedure or evolution may be performed, at 103. Such procedures are well known in the art, and they may include a fracturing operation, gravel packing, or using pressure to set a tool such as a packer. Such procedures and evolutions require fluid pressure in excess of the hydrostatic or pumping pressure that is typically present. The isolation element may be used to prevent the excessive pressure from being communicated below the seat where the device is seated, thereby protecting lower formations and well equipment from the pressure.

Next, the method may include allowing the degradable device to degrade, at 104. If the useful life of the degradable device is not longer than the evolution to be performed, it may be required to deploy a second degradable device, as shown in 101. If the useful life of the degradable device is longer than the evolution to be performed, it may be necessary to wait for some period time for the degradable device to degrade so that it is not longer blocking flow and pressure. Once the time has elapsed, the method may include verifying that flow has been restored, at 105, for example, by pumping fluid and verifying that there is fluid flow or pressure changes below the position of the degradable element.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An isolation element, comprising:

a body having at least one sealing surface;

an internal cavity within the body;

a chemical agent disposed within the internal cavity; and a degradable bladder disposed within the cavity and being adapted to degrade in the presence of a well fluid, wherein the chemical agent is configured to substantially increase a rate of degradation of the body and the chemical agent being disposed within the bladder.

2. The isolation element of claim 1, further comprising:

a passageway between the internal cavity and an outside of the body; and a plug positioned within the passageway to control communication of the well fluid with the degradable bladder.

3. The isolation element of claim 2, wherein the plug is made of a material that degrades in a well fluid.

4. The isolation element of claim 1, wherein the chemical agent is adapted to degrade the body upon contact with the body, and the degradable bladder is adapted to isolate the chemical agent from the body and thereafter allow communication between the chemical agent and the body in response to degradation of the bladder by the well fluid.

5. The isolation element of claim 4, wherein the chemical agent comprises an acid.

6. The isolation element of claim 5, wherein the acid comprises at least one selected from hydrochloric acids, fluoric acids, and nitric acids.

7. The isolation element of claim 1, wherein the chemical agent will react exothermically with a well fluid.

8. The isolation element of claim 7, wherein the chemical agent comprises at least one selected from a metal hydroxide, a hydration agent, and an acid.

9. The isolation element of claim 8, where in the metal hydroxide comprises at least one selected from sodium hydroxide, potassium hydroxide, lithium hydroxide, and cesium hydroxide.

10. The isolation element of claim 8, wherein the hydration agent is selected from the group consisting of metallic nitrates and zinc nitrates.

11. The isolation element of claim 8, wherein the acid comprises at least one selected from hydrogen bromide, hydrogen chloride, hydrogen iodide, aluminum chloride, sulfuric acid, and percholoric acid.

12. The isolation element of claim 1, wherein the isolation element forms one selected from a dart and a ball.

13. The isolation element of claim 1, wherein the internal cavity includes a degradation enhancement feature.

14. The isolation element of claim 13, wherein the degradation enhancement feature comprises a projection into the body.

15. The isolation element of claim 1, wherein the body is comprised at least partly of a material that degrades in a well fluid.

16. A method of actuating a downhole tool in a well, comprising;

positioning a tool in a wellbore using a tubing string;

introducing an isolation element into the tubing string;

as the isolation element descends in the tubing string, responding to hydrostatic pressure present in the tubing string to establish communication of a well fluid with a bladder to degrade the bladder to cause release of a material contained in the bladder for substantially increasing a rate of degradation of a body of the isolation element; and after the isolation valve lands in a flow restriction orifice, actuating the downhole tool by increasing fluid pressure within the tubing string.

17. A method of actuating a downhole tool in a well, comprising;

positioning a tool in a wellbore using a tubing string;

introducing an isolation element into the tubing string;

degrading a plug in the isolation element;

exposing a chemical agent for substantially increasing a rate of degradation of a body of the isolation element, the exposing comprising dissolving a bladder within the isolation element at least in part by exposing the bladder to well fluid; and after the isolation is positioned in a flow restriction orifice, actuating the downhole tool by increasing fluid pressure within the tubing string.

18. An isolation element, comprising:

a body with at least one sealing surface;

means for allowing a well fluid to penetrate into an interior of the body; and means for dissolving a bladder comprising a chemical agent for substantially increasing a rate of degradation of the body when exposed to the well fluid.

* * * * *